US006715701B1

(12) United States Patent
Julien

(10) Patent No.: US 6,715,701 B1
(45) Date of Patent: Apr. 6, 2004

(54) LIQUID JET NOZZLE

(75) Inventor: Gerald J. Julien, Edgewood, WA (US)

(73) Assignee: Nitinol Technologies, Inc., Edgewood, WA (US)

( * ) Notice: Subject to any disclaimer, the term of this patent is extended or adjusted under 35 U.S.C. 154(b) by 527 days.

(21) Appl. No.: 09/231,897

(22) Filed: Jan. 14, 1999

Related U.S. Application Data

(60) Provisional application No. 60/072,728, filed on Jan. 15, 1998.

(51) Int. Cl.[7] ..... B05B 1/00

(52) U.S. Cl. ..... 239/596; 239/429; 239/432; 239/433

(58) Field of Search ..... 239/434, 434.5, 239/596, 597, 429, 430, 432, 433, 601, DIG. 19; 51/438

(56) References Cited

U.S. PATENT DOCUMENTS

| | | | | | |
|---|---|---|---|---|---|
| 2,665,474 | A | * | 1/1954 | Beidler et al. | 239/DIG. 19 |
| 3,174,851 | A | * | 3/1965 | Buehler et al. | 239/596 |
| 3,419,220 | A | * | 12/1968 | Goodwin et al. | 239/596 |
| 3,734,348 | A | * | 5/1973 | White | 222/1 |
| 3,750,961 | A | * | 8/1973 | Franz | 239/600 |
| 3,957,206 | A | * | 5/1976 | Mason | 239/265.33 |
| 4,648,215 | A | | 3/1987 | Hashish et al. | 51/439 |
| 4,660,773 | A | * | 4/1987 | O'Hanlon | 239/596 |
| 4,872,293 | A | | 10/1989 | Yasukawa et al. | 51/410 |
| 4,936,512 | A | * | 6/1990 | Tremoulet, Jr. | 239/596 |
| 4,945,688 | A | | 8/1990 | Yie | 51/438 |
| 5,018,317 | A | | 5/1991 | Kiyoshige et al. | 51/410 |
| 5,033,681 | A | * | 7/1991 | Munoz | 239/596 |
| 5,092,085 | A | | 3/1992 | Hashish et al. | 51/439 |
| 5,144,766 | A | | 9/1992 | Hashish et al. | 51/439 |
| 5,199,640 | A | * | 4/1993 | Ursic | 239/11 |
| 5,259,394 | A | * | 11/1993 | Bens | 607/127 |
| 5,277,366 | A | * | 1/1994 | Ursic | 239/11 |
| 5,381,631 | A | | 1/1995 | Raghavan et al. | 451/75 |
| 5,434,112 | A | * | 7/1995 | Matsui et al. | 239/DIG. 19 |
| 5,643,058 | A | | 7/1997 | Erichsen et al. | 239/596 |

* cited by examiner

*Primary Examiner*—Dina Q. Nguyen
(74) *Attorney, Agent, or Firm*—J. Michael Neary

(57) ABSTRACT

A liquid jet nozzle for forming a high velocity liquid jet from a pressurized liquid, includes a monolithic Nitinol body having an input side and an output side. A tapering lead-in channel opening in the input side and tapers to a central web, through which extends a small diameter orifice, communicating through the web from the lead-in channel to an egress opening in the output side of the body. The orifice interacts with the high pressure liquid to shape the pressurized liquid into a narrow, high velocity liquid jet which exits the body through the egress opening. A surface layer of nickel titanium oxide on the Nitinol in the orifice provides enhanced resistance to erosion by the high pressure liquid.

21 Claims, 3 Drawing Sheets

Fig. 5
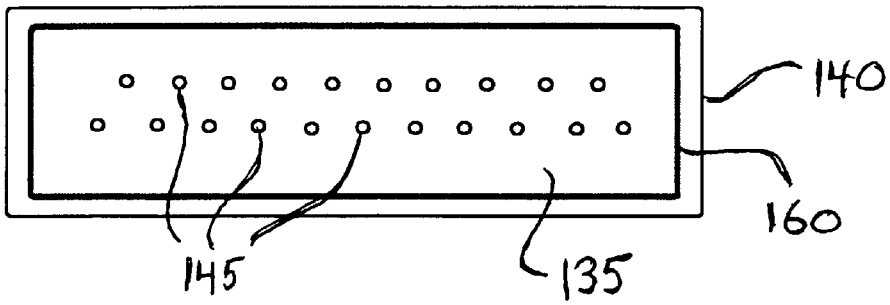
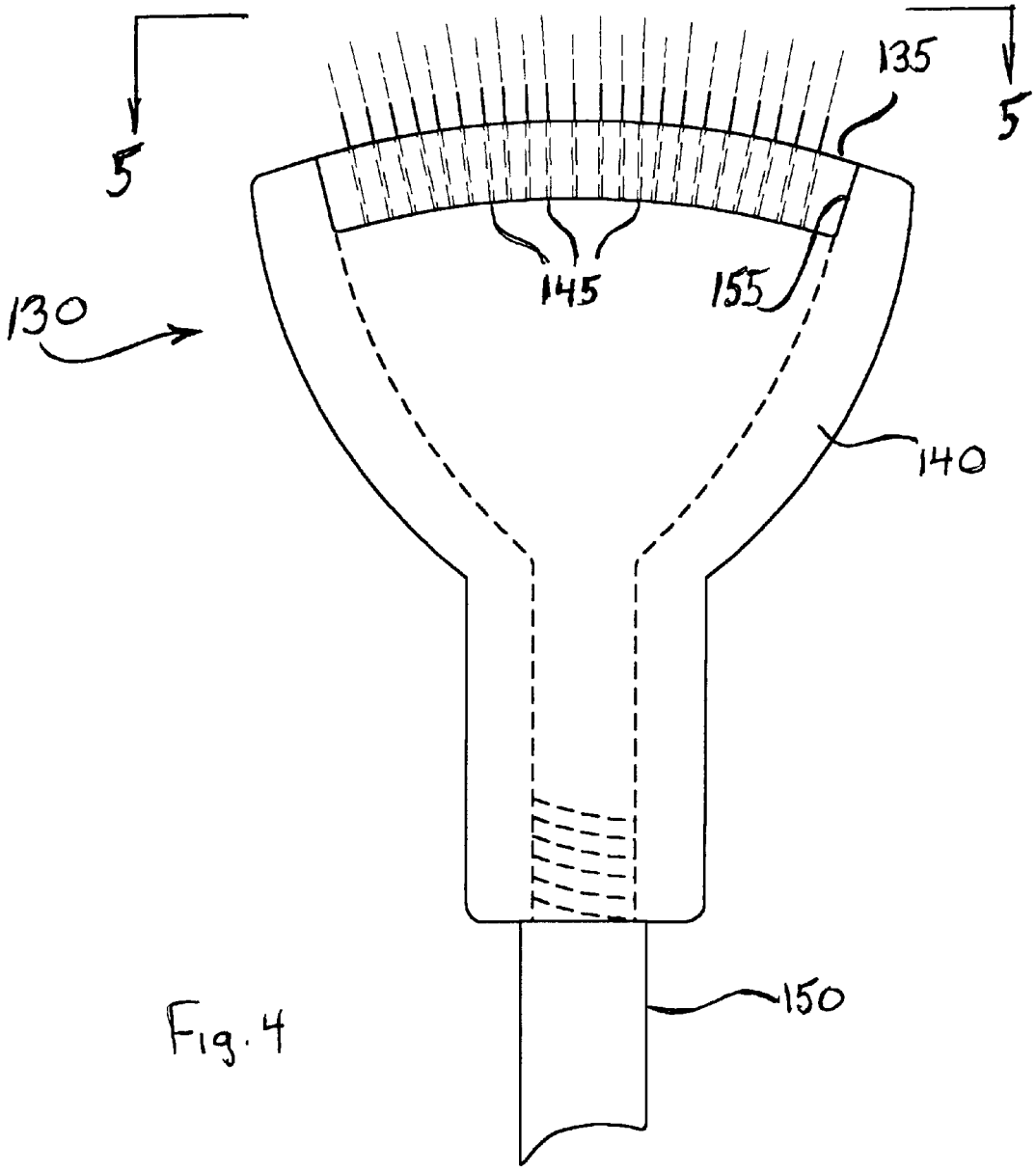
Fig. 4

LIQUID JET NOZZLE

This application claims the benefit of Provisional Application Ser. No. 60/072,728 filed Jan. 15, 1998.

This invention relates to liquid jet nozzles, and more particularly to high pressure erosion resistant nozzles for cutting and cleaning, and methods of making the liquid jet nozzles of Nitinol.

BACKGROUND OF THE INVENTION

Water jet cutting technology was developed in the 1970's for non-contact cutting of many soft materials that cannot be cut as cleanly or as fast using conventional shearing or sawing techniques. The process uses one or more pumps that pressurize water to a high pressure, typically about 50–60 KPSI, and pass the water through a small orifice, on the order of 2–20 mils, in a nozzle to produce a high velocity water jet.

The water jet cutting technology was improved in the 1980's with the introduction of abrasive water jet cutting, wherein abrasive particles such as garnet are entrained in the water jet in a mixing chamber and the particle-laden jet is passed through a mixing tube where the abrasive particles are concentrated into the central region of the jet. The addition of abrasive particles greatly improved the to speed of cutting and made it possible for the first time to cut hard materials such as steel plate. Water jet and abrasive water jet are now widely used throughout the world for cutting all manner of materials, and the use is growing.

A recent development is to replace water in the water jet with liquid nitrogen to produce a liquid cutting instrument, sometimes known as a nitrojet. The nitrojet is used for cutting and for cleaning, for example for cleaning old paint that is cracked or chipped from a painted surface such as a ship hull or bulkhead. Cutting nozzles for producing narrow, high velocity streams of liquid are referred to generically herein as "liquid jet cutting nozzles"; cleaning nozzles for producing high velocity streams of liquid, usually in the form of multiple streams, are referred to herein as "liquid jet cleaning nozzles". Generically, such nozzles are referred to herein as "liquid jet nozzles".

The most serious problem with existing nozzles for liquid jet instruments is erosion, particularly of the jet orifice and the mixing tube. Liquid moving at high velocity is highly erosive over time and high velocity liquid containing abrasive particles is even more erosive. There are nozzle designs that attempt to concentrate the abrasive particles in the center of the jet, out of contact with the nozzle surfaces, but inevitably some contact occurs which rapidly erodes the mixing tube bore and changes the characteristics of the jet. Typically, the mixing tube must be replaced after as little as one half hour, and usually within 40 hours of operation. The cost of the replacement parts and the necessary down time and labor to install the replacement parts contribute significantly to the operating costs of a liquid jet instrument.

A significant contribution to the erosion of the mixing tube is misalignment of the jet direction with the axis of the mixing tube bore. To achieve alignment, the mixing tube is sometimes pivotally mounted on the nozzle assembly. The principal reason for the misalignment is that the jet emerging from the jewel orifice is not necessarily aimed in the axial direction. The procedure for making the orifice in the jewel and the process for mounting the tiny jewel in the jewel holder are not precise enough to accurately aim the orifice in the desired axial direction. As a consequence, there is little predictability as to the actual exact direction that the jet will have after a jewel has been replaced.

The jewel in the nozzle is typically made of synthetic sapphire about 0.020"–0.050" thick, and the orifice is drilled with a high speed spinning tungsten rod. However, sapphire is a crystalline material and does not naturally form a smooth cylindrical hole. Accordingly, the walls of the orifice in the sapphire disk, or jewel, are sometimes produced with an irregular profile and rough surfaces. The deviation of the orifice surfaces should be within a certain percentage of the nominal radius, preferably within 1%. A rough and irregular orifice may produce a poorly formed jet which can be ineffective in cutting and may be incapable of being properly aimed to coincide with the axis of the mixing tube, so it may produce rapid wear of the mixing tube. That is one reason for the unpredictable nature of the wear rate of mixing tubes in abrasive water jet cutting apparatus.

The jewel is held in position and centered in the jewel holder by a gasket/seal mounting device. If the orifice in the jewel is not exactly centered or if the mounting device does not center the jewel disc in the jewel holder, the jet will be laterally misaligned. More importantly, if the disc is not seated properly in the holder or if the orifice is not drilled perfectly axial in the disc, the jet will not be axially aligned with the axis of the machine and with the bore of the mixing tube. The result will be rapid wear of the mixing tube.

Pressure fluctuations can occur in a liquid jet apparatus and if back pressure develops, even momentarily, it can blow the jewel out of its seat in the jewel holder. If this occurs, the effective size of the orifice becomes the size of the central hole through the seat, which is far too large to produce an effective cutting jet and requires that the jewel and jewel holder be replaced. Naturally, this entails machine down time while the jewel and jewel holder are replaced. Jewel replacement is costly in terms of replacement cost, labor and machine down-time.

There are several other factors that affect the performance of a liquid jet cutting nozzle. The ratio of jet orifice diameter to length has an effect on repeatably producing nozzle orifices that aim the jet accurately in the axial direction. The orifice surface coefficient of friction with the liquid and the orifice surface finish and orifice surface material toughness and hardness all affect the performance and durability of the liquid jet cutting nozzle.

SUMMARY OF THE INVENTION

Accordingly, it is an object of this invention to provide an improved liquid jet nozzle made of Nitinol. Another object of this invention is to provide economical, reliable and repeatable processes for producing liquid jet nozzles made of Nitinol.

These and other objects of the invention are attained in a monolithic Nitinol body having a lead-in channel ending in an integral central web. A small diameter orifice communicates through the web from the lead-in channel to an exit opening in the output side of the body through which the liquid jet exits the body. The orifice is defined by a cylindrical wall having a circular cross section with a smooth, hard, durable surface finish and minimal deviation from nominal circularity.

DESCRIPTION OF THE DRAWINGS

The invention and its many attendant advantages and objects will become better understood upon reading the following detailed description of the preferred embodiments in conjunction with the following drawings, wherein:

FIG. 4 is a sectional elevation of a liquid jet cleaning nozzle; and

FIG. 5 is a view of the end of the liquid jet cleaning nozzle along lines 5—5 in FIG. 4.

DESCRIPTION OF THE PREFERRED EMBODIMENTS

Figures 1, 2:
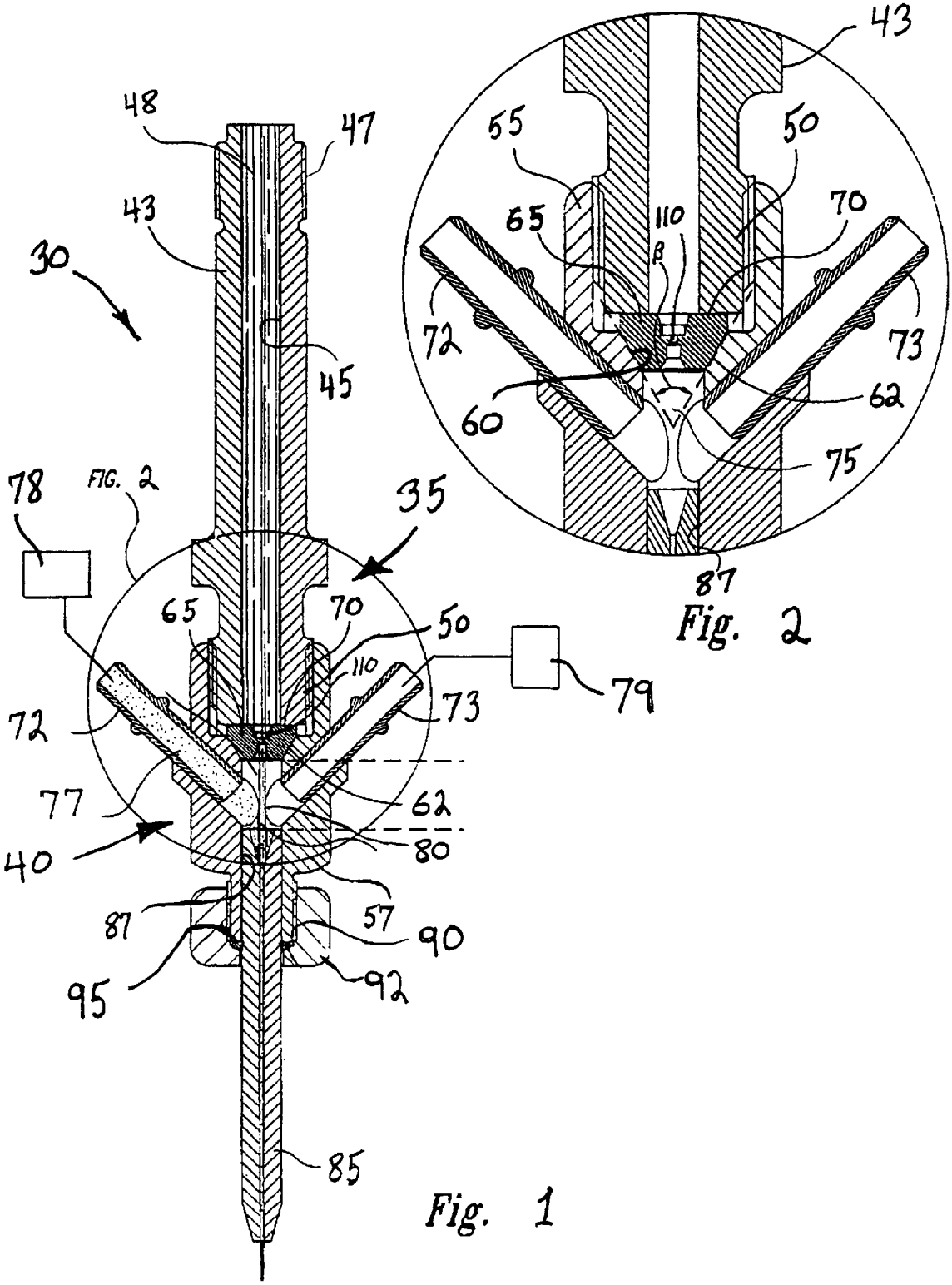
FIG. 1 is a sectional elevation of an abrasive water jet cutting device made in accordance with this invention.
FIG. 2 is an enlarged sectional elevation the central area of the abrasive water jet cutting device shown in FIG. 1.

The invention will be described first as embodied in an abrasive water jet cutting device 30, shown in FIGS. 1 and 2, having an upper water jet section 35 and a lower abrasive entrainment section 40. The basic design of this device is shown in U.S. Pat. 5,643,058, the disclosure of which is incorporated herein by reference. The upper water jet section 35 includes a cylindrical pressure conduit 43 having an axial through bore 45. The conduit 43 is externally threaded at its upper end 47 in FIG. 1 to receive a coupling (not shown) by which a high pressure water line is attached to the top of the conduit 43 to supply liquid, such as water 48, at an elevated pressure, typically 50–60 KPSI. The lower end 50 of the conduit 43 is externally threaded for attachment to an internally threaded receptacle 55 on the top of an entrainment body 57. The entrainment body 57 has an axial tapered seat 60 against which fits a conical surface 62 of a nozzle 65, which is held against the conical seat 62 by engagement of the bottom surface 67 of the conduit 43 against the top surface 70 of the nozzle 65. The nozzle 65 is made of a monolithic Nitinol body, as described below.

The entrainment body 57 has two fittings 72 and 73 which communicate through the side of the entrainment body 57 to a central chamber 75 in which abrasive particles 77 are introduced into a liquid jet 80 produced by the nozzle 65. The fitting 72 is connected to an abrasive powder supply apparatus 78 of known design, such as the apparatus shown in U.S. Pat. No. 5,643,058. The fitting 73 couples the chamber 75 to a piercing eductor 79 for starting a hole in the middle of a work piece.

A mixing tube 85 is fitted into an axial bore 87 in the entrainment body 57, axially opposed to the threaded receptacle 55 and aligned with the axis of the conical seat 60. The lower end of the entrainment body 57 is necked down and externally threaded at 90 to receive an internally threaded compression nut 92 which compresses a sealing gland 95 around the junction of the mixing tube and the necked down lower section 90 of the entrainment body 57 to secure it in position. The entrainment body 57 is accurately machined so that the conical seat 60 and the bore 87 for receiving the mixing tube are precisely axial to ensure that the nozzle 65 is positioned exactly coaxially with respect to the mixing tube 85.

The upper water jet section 35 can be used alone, that is, without the abrasive entrainment section 40, as a water jet cutting nozzle or as a liquid nitrogen jet cutting nozzle. The stand-alone liquid jet nozzle would have a screw-on apertured cap with a conical seat that threads onto the threaded lower end of the pressure conduit 43 to hold the nozzle 65 in place, just as the entrainment body 57 does.

Figure 3:
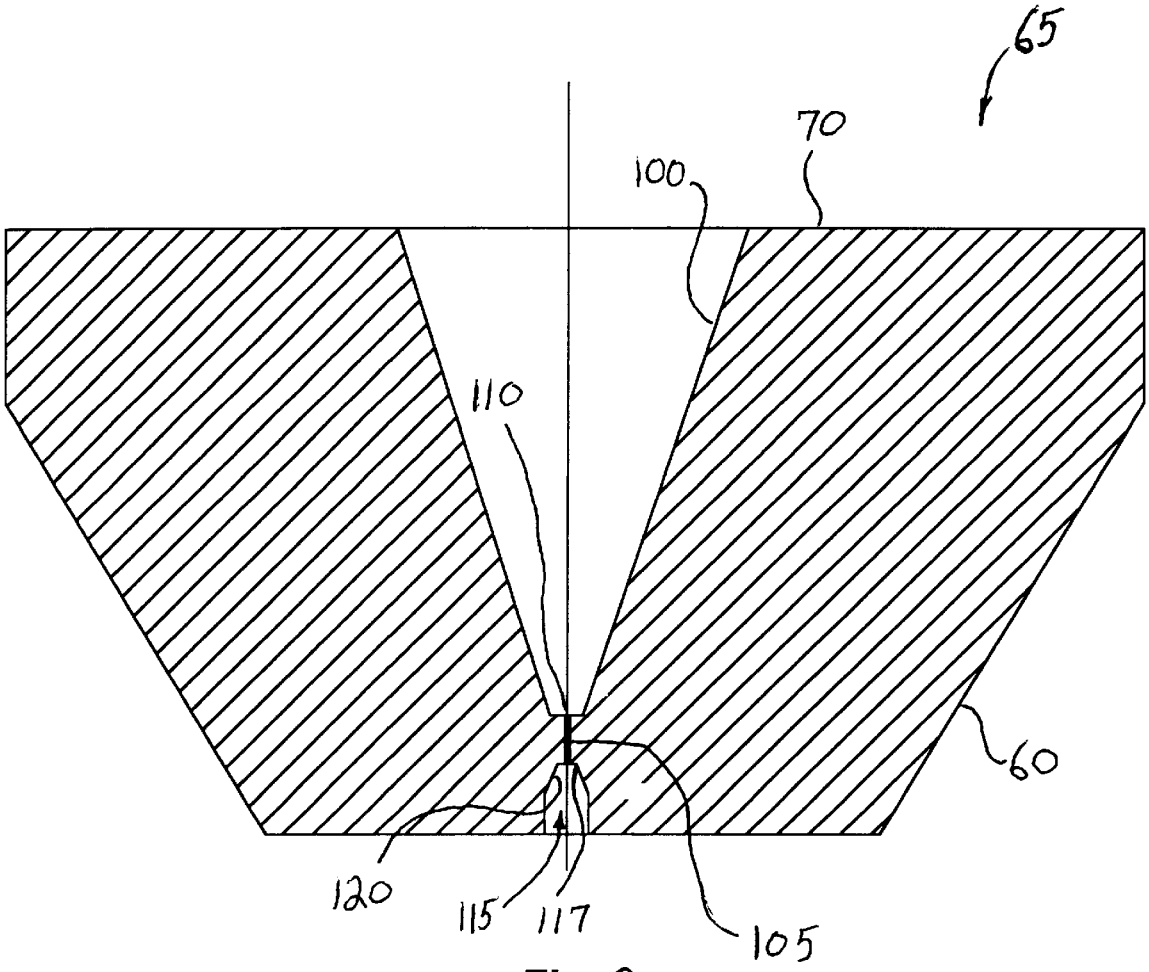
FIG. 3 is an enlarged sectional elevation of the nozzle shown in FIGS. 1–3.

The nozzle 65, shown enlarged in FIG. 3, includes a lead-in channel 100 tapering at an included angle of about 25° to a narrow web 105. An orifice 110 extends through the web 105, communicating between the lead-in channel 100 and an egress opening 115 in the lower face of the nozzle 65. The web 105 has a thickness t of at least about 0.020"–0.100" and an orifice diameter between 1/10 t and 10 t. The egress opening has a flat surface 117 in which the orifice 110 opens and a flaring conical clearance channel 120 extending from the outside edges of the flat surface 117. The shape of the egress opening 115 is not critical, although the flat surface 117 is useful to space the egress opening surfaces away from the emerging liquid jet 80 to ensure that no Coanda effect deflection of the jet 80 occurs by interaction with adjacent surfaces.

Three methods for manufacturing the monolithic Nitinol nozzle 65 are contemplated. The first method starts with a thick sheet or plate of Type 60 Nitinol, rolled to a thickness of about 0.26"–0.30". Two coordination holes are drilled accurately in the plate for accurately locating the plate on the bed of a CNC drilling machine. Aligned lead-in channels 100 and egress channels 115 for multiple nozzles 65 are machined into the Nitinol plate in the center of what will be the nozzles 65 when they are cut out of the plate. The plate is then transferred to the grid of a laser cutting apparatus using the coordination holes to accurately program its X-Y tracking apparatus to cut nozzle discs about 0.50" in diameter out of the plate, each centered around its own aligned channels 100 and 115.

The discs are mounted in live centers of a turning machine such as a lathe. The live centers can use the channels 100 and 115 to center the disc on the axis through the channels 100 and 115. The outer circumference is accurately turned to the desired outer diameter of about 0.49", and the tapering surface 62 is machined, exactly coaxial with the channels 100 and 115.

After turning, the discs are pressed into accurately machined holes in a steel mounting plate for EDM drilling. The EDM probe, known commonly as a "stinger", is positioned precisely on the axis of the aligned channels 100 and 115 by edge detectors which detect the edges of the channel 100 and centers the stinger on the axis to drill the orifice 110. After all the orifices of the nozzle discs in the mounting plate have been drilled, the nozzles are pressed out of the mounting plate and are inspected and packed for shipment.

The second manufacturing process for making the nozzles 65 also starts with a rolled plate of Type 60 Nitinol as before. This plate, however, is laser cut into square bars by making parallel cuts lengthwise of the plate, spaced apart about the thickness of the plate, about 0.26"–0.30". The bars are straightened and the mounted in a screw machine or the like to be ground to roughly a cylindrical shape. A tool post grinder is effective for this purpose and can do the job automatically. The roughly cylindrical rods are now-ground to precision desired outside diameter of the nozzle 65, or 0.490" in this example, in a centerless grinder. The precision ground rod is mounted in a lathe or screw machine and V-grooves are cut into the rod corresponding the tapered surfaces 60. The rod is now cut into discs by a carbide or diamond band saw or by rotating the bar under a fixed laser beam.

The discs that are cut from the bar can be directly pressed into precision holes in a steel mounting plate. The mounting plate can be provided with coordination holes by which a CNC machine tool can accurately locate the center of each disc by reference to the known relationship between the mounting holes and the coordination holes. The lead-in channel 100 and the egress channel 115 can be cut by the CNC machine tool and the orifice 110 is "drilled" or burned as described in the first process.

The third process uses plasma spraying of Type 60 Nitinol into a cup-shaped form having a central projection corresponding to the egress channel 115. A super elastic Nitinol wire is fixed in to top of the projection and the Nitinol is plasma sprayed into the form. After the form is filled and cooled, the form is removed by dissolving in acid or pealing off on prescored lines. The superelastic wire can be pulled or dissolved out of the Nitinol body, leaving an orifice equal in diameter to the diameter of the wire. The lead-in channel 100 can be machined as before by mounting the Nitinol disc body in a hole whose position is accurately known in a mounting plate and directing a cutter of a CNC machine tool to the axial center of the hole to machine the lead-in channel 100.

A hard, corrosion resistant and slippery surface of nickel-titanium oxide (NiTiOx) is put on all surfaces of the nozzle 65, especially in the orifice 105, by heating the nozzle 65 to a temperature of about 850° F. in an atmosphere containing oxygen, and allowing the nozzle to cool to room temperature. The NiTiOx surface produced thereby is integral with the monolithic Nitinol nozzle 65 and affords excellent erosion protection as well as protection from low temperature thermal shock and embrittlement.

The direction of the jet is influenced by the quality of the orifice. The EDM drilled hole is extremely precise and has a high degree of surface smoothness and axial straightness. The consistency of quality from nozzle to nozzle is superior to that of sapphire nozzle discs.

Turning now to FIGS. 4 and 5, a spray nozzle 130 is shown having a curved spray head 135 mounted in a spray body 140. The spray head 135 is a monolithic Nitinol plate, preferably about ⅛"–¼" thick, although other the thickness is primarily determined by the pressure behind the spray head and the material being sprayed, so plate material of other thickness can be used where appropriate. A plurality of orifices 145 in the spray head 135 allow pressurized liquid delivered through a supply pipe or hose 150 to the spray body 140 to exit in a desired pattern, determined by the pattern of the orifices 145 in the spray head 135.

The spray head 135 is made as a rectangular bar of Nitinol, preferably Type 60 Nitinol which is cut by laser from a rolled sheet of the material, purchased from any of several vendors, such a Duriron Co. The orifices 145 are cut using a laser or, if very small or fine holes are needed, using an EDM drilling process noted above. The bar is then formed in the curved shape shown in FIG. 4 by heating to a high temperature of about 700° C.–850° C. and pressing into a female die shaped with the desired curvature. The bar is held in the die and allowed to cool to below 500° C. before removing from the die. It will retain the formed shape after removal from the die, without springback.

The orifices 145 in the formed spray head 135 are inspected to ensure that the forming process did not create burrs or other damage to the ingress or egress ends of the orifices 145. If the tools used in the forming process for curving the spray head 135 are found to damage the orifices 145, a lead-in channel and an egress channel can be employed, similar to the lead-in and egress channels 100 and 115 in the nozzle 65.

The finished spray head 135 is mounted in the spray body 140, which is preferably a titanium alloy casting having a rectangular end opening 155 into which the spray head 135 fits with a snug fit. The spray head is welded in place with TIG welding using an argon atmosphere or using laser welding, also with an argon or other noble gas atmosphere blanket.

The spray nozzle 130 can be used with high pressure water or liquid nitrogen to remove paint, barnacles, and other fouling from ship hulls and other hard surfaces. It can also be used to apply viscous materials such as adhesives and resins that are otherwise difficult to apply because of their viscosity and resistance to shear.

Obviously, numerous modifications and variations of the method and apparatus disclosed herein will occur to those skilled in the art in view of this disclosure. For example, many objects, functions and advantages are described for the preferred embodiments, but in many uses of the invention, not all of these functions and advantages would be needed. Therefore, I contemplate the use of the invention using fewer than the complete set of noted features, benefits, functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, are to be considered within the spirit and scope of the invention as defined in the following claims, wherein I claim:

1. A liquid jet nozzle for forming a high velocity liquid jet from a pressurized liquid, comprising:

a monolithic Nitinol body having an input side and an output side;

a tapering lead-in channel opening in said input side and tapering to a central web;

a small diameter orifice communicating through said web from said lead-in channel to an egress opening in said output side, said orifice interacting with said high pressure liquid to shape said pressurized liquid into a narrow, high velocity liquid jet which exits said body through said egress opening.

2. A liquid jet cutting nozzle as defined in claim 1, wherein:

said Nitinol body is Type 60 Nitinol.

3. A liquid jet cutting nozzle as defined in claim 2, further comprising:

a surface layer of nickel titanium oxide on said Nitinol in said orifice.

4. A liquid jet cutting nozzle as defined in claim 1, wherein:

said web has a thickness t of at least about 0.020"–0.100" and an orifice diameter between 1/10 t and 10 t.

5. An erosion resistant liquid jet cutting nozzle, comprising:

a monolithic Nitinol body having a lead-in channel ending in an integral central web;

a small diameter orifice communicating through said web from said lead-in channel to an exit opening in an output side of said body through which the liquid jet exits the body;

said orifice being defined by a cylindrical wall having a circular cross section with a smooth, hard, durable surface finish and minimal deviation from nominal circularity.

6. A liquid jet cutting nozzle as defined in claim 5, wherein:

said smooth, hard, durable surface finish of said orifice cylindrical wall is nickel-titanium oxide.

7. A liquid jet cutting nozzle as defined in claim 6, wherein:

said nickel-titanium oxide surface finish of said orifice is integral with said monolithic Nitinol body.

8. A liquid jet cutting nozzle as defined in claim 5, wherein:

said Nitinol is Type 60 Nitinol.

9. In a liquid jet apparatus having a pressurizing device for raising liquid to an elevated pressure and a conduit for conducting said pressurized liquid to a jet nozzle, an apparatus for forming a jet of said liquid, comprising:

a nozzle body having an orifice made of monolithic Type 60 Nitinol through which said liquid flows to form said liquid jet.

10. An apparatus as defined in claim 9, wherein:

said orifice has a surface finish of hard, durable, slippery NiTiOx.

11. An apparatus as defined in claim 10, wherein:

said nozzle body is made entirely of Type 60 Nitinol and all surfaces of said nozzle body have said surface finish of hard, durable slippery NiTiOx.

12. An apparatus as defined in claim 10, wherein:

said surface finish of hard, durable slippery NiTiOx is formed by heating said nozzle body to an elevated temperature in an oxygen-containing atmosphere.

13. A liquid jet nozzle for forming a high velocity liquid jet from a pressurized liquid, comprising:

a nozzle body made of monolithic Nitinol, said body having an input side and an output side;

an orifice communicating through said body to an egress opening in said output side, said orifice interacting with said pressurized liquid to shape said pressurized liquid into a liquid jet which exits said body through said egress opening.

14. A liquid jet nozzle as defined in claim 13, wherein:

said Nitinol is Type 60 Nitinol.

15. A liquid jet nozzle as defined in claim 14, further comprising:

a tapering lead-in channel opening in staid input side communicating with said orifice.

16. A liquid jet nozzle as defined in claim 1, wherein:

a surface layer of nickel titanium oxide on said Type 60 Nitinol in said orifice.

17. An erosion resistant liquid jet nozzle, comprising:

a nozzle body having a monolithic Nitinol orifice communicating through said body from an input end to an exit opening in an output side of said body through which the liquid jet exits the body.

18. A liquid jet nozzle as defined in claim 17, wherein:

said orifice is defined by a cylindrical wall having a circular cross section with a smooth, hard, durable surface finish and minimal deviation from nominal circularity.

19. A liquid jet nozzle as defined in claim 18, wherein:

said smooth, hard, durable surface finish of said orifice cylindrical wall is nickel-titanium oxide.

20. A liquid jet nozzle as defined in claim 19, wherein:

said nickel-titanium oxide surface finish of said orifice is integral with said monolithic Nitinol body.

21. A liquid jet cutting nozzle as defined in claim 17, wherein:

said Nitinol is Type 60 Nitinol.

* * * * *